US005646477A

United States Patent [19]

Yamagishi

[11] Patent Number: 5,646,477

[45] Date of Patent: Jul. 8, 1997

[54] X-RAY IMAGE INTENSIFIER

[75] Inventor: Shirofumi Yamagishi, Ohtawara, Japan

[73] Assignee: Kabushiki Kaisha Toshiba, Kawasaki, Japan

[21] Appl. No.: 725,502

[22] Filed: Oct. 4, 1996

Related U.S. Application Data

[63] Continuation of Ser. No. 335,777, filed as PCT/JP94/00430, Mar. 17, 1994, abandoned.

[30] Foreign Application Priority Data

Mar. 17, 1993 [JP] Japan ..... 5-056270

[51] Int. Cl.[6] ..... H01J 31/26

[52] U.S. Cl. ..... 313/365; 313/373; 313/375; 313/527; 250/214 VT

[58] Field of Search ..... 313/365, 375, 313/525, 526, 527, 534, 373, 530, 541, 542; 250/214 VT, 207

[56] References Cited

U.S. PATENT DOCUMENTS

| | | | |
|---|---|---|---|
| 4,069,355 | 1/1978 | Lubowski et al. . | |
| 4,195,230 | 3/1980 | Ataka et al. . | |
| 4,300,046 | 11/1981 | Wang . | |
| 4,935,617 | 6/1990 | Anno | 313/527 |
| 5,083,017 | 1/1992 | Anno | 313/541 |
| 5,338,926 | 8/1994 | Yoshida | 250/214 VT |

FOREIGN PATENT DOCUMENTS

| | | |
|---|---|---|
| 0083225 | 7/1983 | European Pat. Off. . |
| 1557119 | 2/1969 | France . |
| 1284529 | 7/1969 | Germany . |
| 2137392 | 2/1973 | Germany . |
| 34-20832 | 12/1959 | Japan . |
| 55-150535 | 11/1980 | Japan . |
| 59-75544 | 4/1984 | Japan . |

*Primary Examiner*—Sandra L. O'Shea
*Assistant Examiner*—Vip Patel
*Attorney, Agent, or Firm*—Cushman Darby & Cushman IP Group of Pillsbury Madison & Sutro, LLP

[57] ABSTRACT

An X-ray image intensifier that includes a vacuum envelope having a metal X-ray input window and an input screen formed on the inner surface of the X-ray input window, a focusing electrode, an anode, and an output screen arranged in the vacuum envelope along the traveling direction of electrons generated from the input screen. The X-ray input window has a rough, surface-hardened layer on the side on which the input screen is formed. The input screen includes a phosphor layer adjacent to the rough, surface-hardened layer and a photocathode formed on the phosphor layer.

21 Claims, 3 Drawing Sheets

X-RAY IMAGE INTENSIFIER

This is a continuation of application No. 08/335,777, filed as PCT/JP94/00430, on Mar. 17, 1994, which was abandoned.

TECHNICAL FIELD

The present invention relates to an X-ray image intensifier.

BACKGROUND ART

Recently, an X-ray image intensifier has been widely applied for the purposes of medical diagnosis, non-destructive examinations and the like. In these applications, an X-ray image obtained by a low-energy X-ray having an X-ray tube voltage of 30 KV (a tube current of 1 mA) or less, or by a high-energy X-ray having an X-ray tube voltage of 30 KV (a tube current of 1 mA) or more, is converted to a visible light image.

As shown in FIGS. 1 and 2, a conventional X-ray image intensifier is basically constructed of an input screen 12, a focusing electrode 13, an anode 14, and an output screen 15, all arranged in a vacuum envelope 11 (hereinafter referred to as an "envelope"). These components are arranged in the order mentioned above, in a direction away from an X-ray source A. The envelope 11 has an input window 11*a* made of metal, on which an X-ray is incident, a body 11*b* made of glass for supporting the focusing electrode 13, and an output portion 11*c* made of optical glass serving as the output screen 15 or as a support for the output screen 15.

The input screen 12, which is provided at a predetermined distance from the input window 11*a*, functions as a cathode. The input screen 12 is constructed of a curved substrate 12*a*, for example, an aluminum metal substrate, which has a convex surface formed so as to project toward the X-ray source A. The input screen 12 further includes a phosphor layer 12*b* for converting an X-ray to visible light, and is formed on the opposite surface of the metal substrate 12*a*. A transparent conductive film 12*c* formed on the phosphor layer 12*b* and a photocathode 12*d* for converting the visible light from the phosphor layer 12*b* to electrons, formed on the transparent conductive film 12*c* also make up the input screen. The transparent conductive film 12*c* is generally made of indium oxide, ITO (a compound made of indium oxide and titanium oxide) or the like. The transparent conductive film 12*c* prevents reaction between an alkali halide such as sodium iodide activated cesium iodide phosphor layer 12*b* and a material constituting the photocathode 12*d* and provides continuous conductivity on the surface of the phosphor layer 12*b*.

On the other hand, an anode 14 is disposed at the opposed side to the input screen 12, namely, at the side in which the output screen 15 is disposed (the outer face herein has a structure such that the optical glass substrate supporting output phosphors serves as part of the envelope). The anode 14 is supported by the side in which an envelope output portion 11*c* is formed. Between the anode 14 and the input screen 12 used as the cathode, a first focusing electrode 13*a* is provided along the inner wall of the envelope body 11*b*. Between the first focusing electrode 13*a* and the output screen 15, a pipe-shape second focusing electrode 13*b* is provided. The first and the second focusing electrodes 13*a* and 13*b* define an electrostatic electron lens system.

In the X-ray image intensifier, an X-ray B radiated from the X-ray source A is transmitted through an object C, reaching the input window 11*a*. The X-ray image reflected on the input window 11*a* is converted to an electron image formed on the input face, as will be described later. The electron image is accelerated and focused through the electrostatic electron lens system defined by the first focusing electrode 13*a* and the second focusing electrode 13*b*. A tube voltage, which is applied between the input screen 12 as the cathode and the anode 14, e.g., 30 KV of a tube voltage, is divided into two voltages and these voltages are applied to the electrodes, 13*a*, 13*b*, respectively. Thereafter, the electron image is converted back into a visible light on the output screen 15. In this way, a visible image can be intensified, for example, 1000 times or more, in proportion to the intensity of the visible light entering the input screen 12.

As shown in an enlarged view of FIG. 2, the input screen of the above-mentioned conventional X-ray image intensifier presents a problem in that the X-ray is scattered, lowering image contrast since the input window 11*a* and the input screen 12 are separated by a predetermined distance. Hereinbelow, this problem will be explained by way of example of an X-ray image intensifier having an effective input-screen diameter of 4 inches, with reference to FIG. 3.

To obtain data shown in FIG. 3, a tube voltage of 50 KV and a tube current of 1 mA were applied to the X-ray tube. A contrast (%) and a contrast ratio of the X-ray image intensifier are plotted on a vertical axis and a diameter (mm) of a lead circular plate is plotted on the horizontal axis. The contrast herein is indicated in percentage of brightness in the effective input visual field when a lead plate having a predetermined diameter is positioned at the center of the effective input visual field, based on the brightness in the effective input visual field of the X-ray image intensifier when no lead plate is positioned. The contrast ratio is numerically calculated from the contrast values (%).

A curve c of FIG. 3 shows the characteristics of the X-ray image intensifier having the conventional structure shown in FIG. 2. As is apparent from the curve c, as the diameter of the lead circular plate used in measuring contrast becomes smaller than 40 mm, the image contrast significantly reduces. This fact implies that the contrast of a small object image is significantly inferior to that of a large object. From the industrial point of view, this fact leads to a drawback in that it is more difficult to find defects of fine portions in a larger object.

FIG. 4 shows the contrast data obtained from an experiment conducted in the above described manner except that a tube voltage of the X-ray tube is changed to 30 KV, using the same X-ray intensifier. According to the straight line e of FIG. 4, in the same fashion as in the curve c of FIG. 3, as the diameter (mm) of the lead circular plate becomes smaller than 40 mm, the contrast significantly reduces. However, the degree of the image contrast reduction in this case is larger than in the case of FIG. 3.

On the other hand, Jpn. UM Appln. KOKOKU Publication No. 34-20832 and some other publications disclose an X-ray image intensifier comprising an input screen directly formed on the inner surface of an aluminum input-window. However, such an X-ray image intensifier comprising an input screen directly formed on an inner surface of an input window made of aluminum has not yet been put into practical use. If an X-ray image intensifier comprising the input window made of such a thin material is fabricated and then evacuated, the input window will be distorted by the pressure difference between the inside and the outside of the tube. As a consequence of the input screen being distorted, a desired photocathode cannot be obtained and the output image is distorted.

DISCLOSURE OF INVENTION

The object of the present invention is to provide an X-ray image intensifier which overcomes the aforementioned drawbacks, maintains high brightness of an image, and provides high image contrast.

According to the present invention, there is provided an X-ray image intensifier which includes a vacuum envelope having a metal X-ray input window and an input screen formed on the inner surface of the X-ray input window. A focusing electrode, an anode, and an output screen are arranged in the vacuum envelope along the traveling direction of electrons generated from the input screen. The X-ray input window has a surface-hardened layer with a rough surface on a side on which the input face is formed, and the input face includes a phosphor layer formed on the surface-hardened layer and a photocathode formed on the phosphor layer.

In the X-ray image intensifier of the present invention, a material which can be used as the metal X-ray input window is a substance, for example, aluminum or an aluminum alloy, which has a high X-ray transmissivity, good workability, and sufficient strength to tolerate the pressure difference between the outside and the inside of the X-ray image intensifier caused by surface hardening.

The rough, surface-hardened layer of the metal X-ray input window can be formed by surface-hardening to a metal plate which forms the metal X-ray input window. The treatment for forming the rough, surface-hardened layer can be performed as follows:

Hard spherical particles such as glass beads having a particle diameter of 50 to 200 μm are impinged onto the metal plate at a pressure of 1 to 4 kg/cm$^2$ for a processing time of 1 to 5 minutes, thereby completing the surface hardening. As a result, the surface of the metal plate becomes rough, providing a surface-hardened layer with a rough surface.

The X-ray image intensifier of the present invention is particularly effective in the case where a low-energy X-ray having a X-ray tube voltage of 30 KV (1 mA in a tube current) or less is used.

BEST MODE OF CARRYING OUT THE INVENTION

Figure 1:
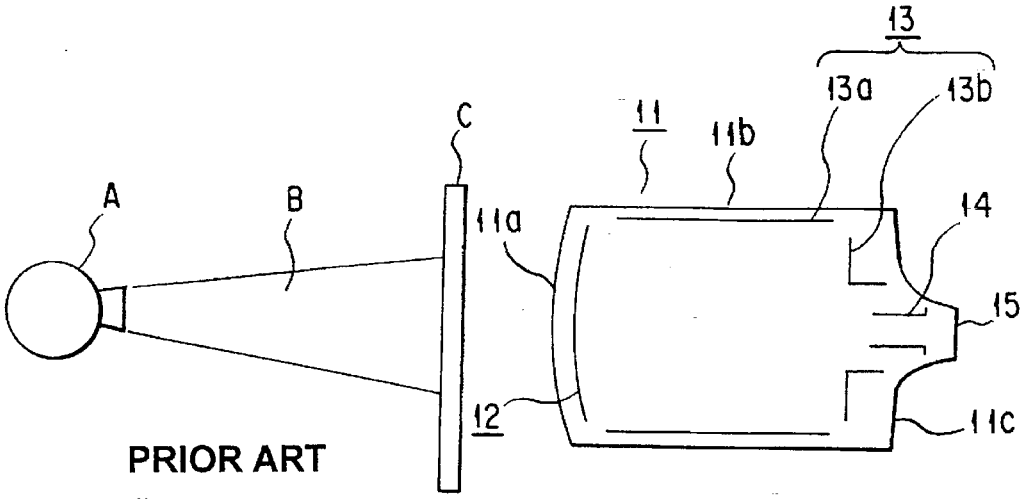
FIG. 1 is a schematic view of a conventional X-ray image intensifier, which is used herein for explaining X-ray photography.
Figure 2:
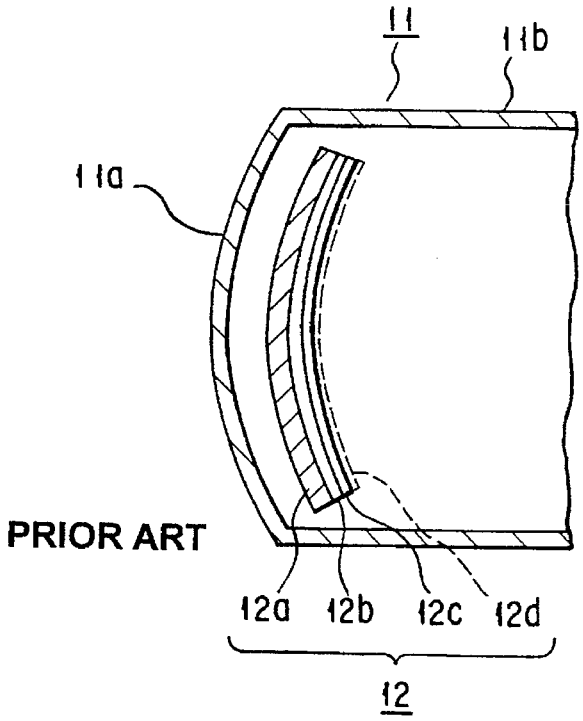
FIG. 2 is a sectional view of part of the conventional X-ray image intensifier shown in FIG. 1.

The X-ray image intensifier of the present invention has the same arrangement as that of the conventional X-ray image intensifier shown in FIG. 1, except that an input screen is formed directly on the inner surface of an input window and surface-hardening is conducted on the inner surface of the input window.

Figure 5:
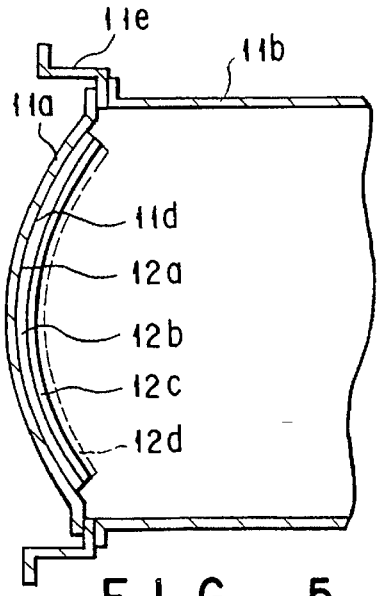
FIG. 5 is an partially enlarged sectional view of a main portion of the X-ray image intensifier according to an embodiment of the present invention.

More specifically as shown in FIG. 5, the X-ray image intensifier of the present invention includes the input screen 12, the electrode 13, the anode 14, the output screen 15, all disposed in the vacuum envelope 11, which are arranged in the above mentioned order along a direction away from the X-ray source A. The envelope 11 further includes the metal input window 11*a*, to which an X-ray is radiated, the glass body 11*b* supporting the focusing electrode, and the glass output portion 11*c* serving as the output screen 15 or a support for the output screen 15.

Figure 6:
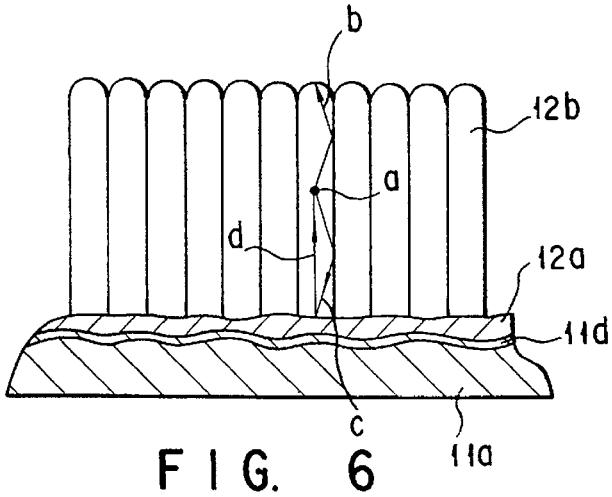
FIG. 6 is a partially enlarged sectional view of the portion shown in FIG. 5.

As shown in FIG. 6, the surface-hardened layer 11*d* having a rough surface obtained by the surface hardening is formed on the inner surface of the input window 11*a*. An aluminum alloy, in particular, an ASTM 5000 series Al-Mg alloy, is used as the material of the input window 11*a*. Such an aluminum alloy plate is press-molded into a dash shape and the aforementioned surface-hardening is applied thereto, thereby providing the input window 11*a*.

The input screen 12 is formed directly onto the rough-surface of the surface-hardened layer 11*d*. The input screen 12 is constructed of the optically reflective substance layer 12*a* formed on the rough-surface of the surface-hardened layer 11*d;* the phosphor layer 12*b* for converting an X-ray to a visible light, formed on the layer 12*a;* the transparent conductive film 12*c* formed on the phosphor layer 12*b;* and the photocathode 12*d* for converting the visible light from the phosphor layer 12*b* into electrons, formed on the transparent conductive film 12*c*. The transparent conductive film 12*c* is generally made of indium oxide, ITO (a compound made of indium oxide and titanium oxide) or the like. The transparent conductive film 12*c* is used for preventing reaction between an alkali halide such as sodium iodide activated cesium iodide forming the phosphor layer 12 and a material forming photocathode 12*d*, and for providing continuous conductivity on the surface of the phosphor layer.

On the other hand, an anode 14 is disposed at the opposed side of the envelope with respect to the input screen 12, namely, at the side in which the output screen 15 is disposed (the output screen possesses a structure such that an optical glass substrate supporting output phosphors serves as part of the envelope). The anode 14 is supported by the side in which an envelope output portion 11*c* is placed. Between the anode 14 and the input screen 12 serving as the cathode, a first focusing electrode 13*a* is provided along the inner wall of the envelope body 11*b*. Between the focusing electrode 13*a* and the output screen 15, a pipe-shaped second focusing electrode 13*b* is provided. The first and the second focusing electrodes 13*a* and 13*b* form an electrostatic electron lens system in the same fashion as in the structure of the X-ray image intensifier shown in FIG. 1.

As described above, according to the X-ray image intensifier of the present invention, the rough, surface-hardened layer 11*d* is formed on the inner surface of the input window 11*a*, and the input screen 12 is formed directly on the rough, surface-hardened layer. The Vickers hardness of the rough, surface-hardened layer 11*d* is preferably in a range of 120 to 250 as described above. If the Vickers hardness is less than 120, the layer lid will not be strong enough to tolerate the pressure difference between the inside and the outside of the X-ray image intensifier, and the X-ray input window will be distorted. In contrast, if the Vickers hardness exceeds 250, the moldability of the layer 11*d* will unfavorably deteriorate.

The surface roughness of the rough, surface-hardened layer 11*d* is preferably in a range of 1 to 10 μm. If the roughness is less than 2 μm, the hardness of the rough, surface-hardened layer 11*d* is too low to tolerate the pressure difference between the inside and the outside of the X-ray image intensifier, thereby causing the X-ray input window 11*a* to be distorted. In contrast, if the roughness exceeds 10 μm, phosphors to be formed on the layer 11*d* exhibit weak adhesiveness, and such that the layer exhibits disadvantageous film quality.

The present inventors have conducted an experiment in the following manner with a view to find the relationship between the surface roughness of the surface-hardened Al alloy, the hardness of the treated surface, the adhesiveness of phosphors to the treated surface, and the phosphor-film quality.

The aforementioned Al-Mg alloy plate of 0.5 mm in thickness was molded into the shape of the input window, and then subjected to surface-hardening by use of glass beads of 100 μm in diameter. Al-alloy input-window samples having a wide variety of surfaces roughness were obtained by varying the pressure and the processing time.

Figure 7:
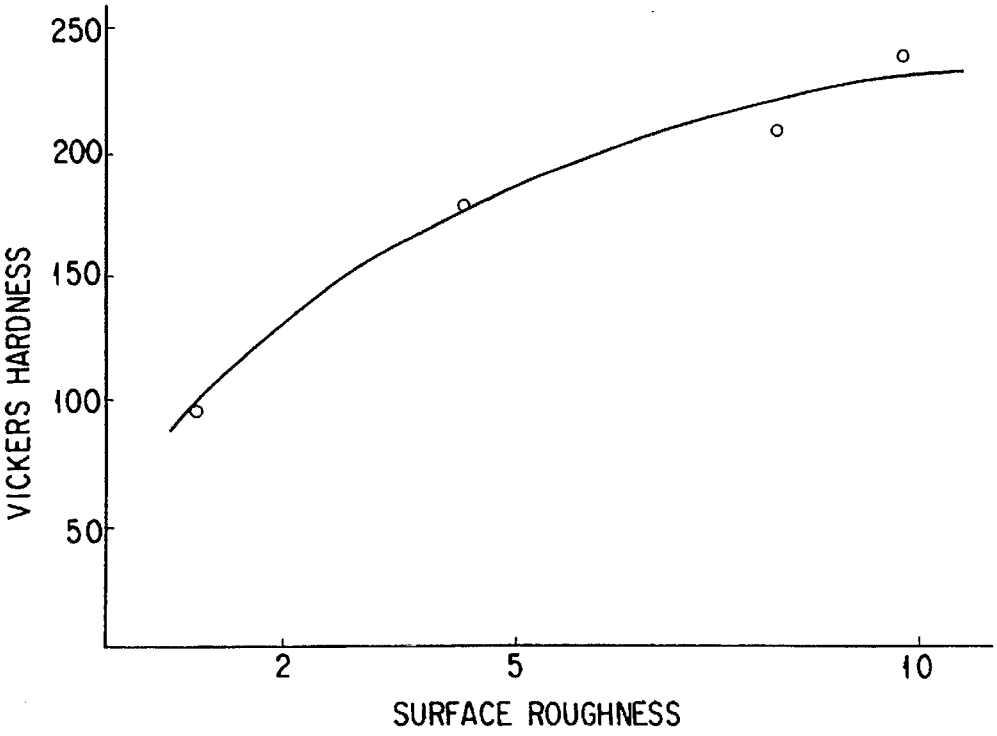
FIG. 7 is a graph showing the relationship between the surface roughness of an Al plate obtained by surface hardening and the hardness of the surface-hardened layer.

The Vickers harnesses of the treated surfaces of the Al input-window samples were measured. The results are shown in FIG. 7. From the graph of FIG. 7, it is found that the surface of the input window must have a roughness of 2 μm or more in order to attain the Vickers hardness of 120 or more at which the input window exhibits tolerance to the pressure difference between the inside and the outside of the X-ray image intensifier.

Next, phosphor layers were formed on the treated surfaces of the Al alloy input window samples by vapor-deposition. The adhesiveness and the film quality of the phosphor layers were checked. The results are shown in the following Table 1.

TABLE 1

| Roughness of the treated surface (μm) | x < 2 | 2 < x < 5 | x = 5 | 5 < x < 10 | 10 < x |
|---|---|---|---|---|---|
| Hardness | X | Δ | ○ | ⊙ | ⊙ |
| Adhesiveness | ○ | ○ | ⊙ | ○ | Δ |
| Phosphor film quality | ⊙ | ⊙ | ⊙ | Δ | X |

⊙: very good
○: good
Δ: slightly good
X: not good

Table 1 demonstrates that the surface roughness of the Al-alloy input window plate is preferably 5 or more to obtain sufficient hardness thereof. The surface roughness of the Al-alloy input window is preferably 10 μm or less to obtain sufficient adhesiveness of the window of the phosphor film. Finally, the surface roughness of the Al-alloy input window is preferably 2 to 10 μm to obtain sufficient quality of the phosphor film.

As far as only adhesiveness and the film quality of the phosphor film are concerned, and Al-alloy plate having a surface roughness of 5 μm is the most preferable, whereas, the hardness thereof is not the most preferable. However, even if the surface roughness is 5 μm, it is possible to obtain the most preferable hardness by selection of the manner of the surface-hardening.

More specifically, to obtain the most preferable hardness, the Al-Mg alloy plate (ASTM 5000 series) is molded into the shape identical to the input window, and then subjected to the rough-surface treatment with high pressure, thereby obtaining the surface roughness of 10 μm or more. Second, the Al-plate is subjected to the surface-hardening with low pressure to smooth the projections and recesses which have been formed, thereby attaining the surface roughness of about 5 μm. In this way, it is possible to impart the Vickers hardness of approximately 250 μm to the surface even if the surface roughness thereof is 5 μm.

As described in the foregoing, according to the X-ray image intensifier of the present invention, since the rough, surface-hardened layer is formed on the inner surface of the X-ray input window, the X-ray input window undergoes less distortion as a result of pressure difference, caused by evacuation, between the inside and the outside of the X-ray image intensifier. Due to the presence of a reflective substance layer formed on the rough surface-hardened layer, light generated from the input screen travels toward the photocathode, thereby providing a high contrast output-image.

In the case where Al or an Al alloy is used as a material of the X-ray input window, an x-ray image intensifier having an X-ray input window excellent in moldability can be obtained with advantage in cost.

Further, it is possible to obtain an output image of a small object with higher contrast when the X-ray image intensifier of the present invention employs a low-energy X-ray source.

Hereinbelow, examples of the present invention will be described.

EXAMPLE 1

The X-ray image intensifier according to this example is characterized in that it has an input screen of a specific structure. More particularly, the surface-hardening is applied to the concave surface of the X-ray input window 11*a*, which is made of an aluminum alloy (or aluminum) of 0.5 mm in thickness. Due to surface-hardening, the concave surface becomes rough, having projections of several microns in height and pits of several microns deep. Simultaneously, the surface becomes hard. In this way, a rough surface-hardened layer 11*d* is formed on the concave surface of the X-ray input window 11*a*.

On the rough surface of the rough, surface-hardened layer 11*d*, an aluminum thin film 12*a* of approximately 2000Å, namely, a reflective substance layer, is formed. The aluminum thin film is formed by vapor-deposition under reduced pressure of approximately $2\times10^{-5}$ Pa. On the reflective substance layer 12*a*, a phosphor layer 12*b* of 400 μm in thickness is formed by the vapor-deposition. The phosphor layer 12*b* is manufactured by the two steps: the first layer is formed of CsI/Na phosphors in a thickness of approximately 380 μm under a pressure of $4.5\times10^{-1}$ Pa at a substrate temperature of 180° C. Then, a second layer is formed of CsI/Na phosphors by vapor-deposition to provide a thickness of approximately 200 microns under a pressure of $10^{-3}$ Pa.

The X-ray input window 11*a* including the phosphor layer 12*b* is welded to the envelop body 11*b* via a ring 11*e* made of metal, e.g., steel. The envelope body 11*b* connected to the X-ray input window 11*a* is then connected to the envelope output portion 11*c*. Thereafter, the photocathode 12*d* is formed on the phosphor layer 12*b*, directly or via the transparent conductive layer 12*c*.

In the X-ray image intensifier described above, when the X-ray B from the X-ray source A is transmitted through the object C and introduced into the input window 11*a*, light is generated, for example, at a point a in the phosphor layer 12*b* as shown in FIG. 6. The generated light is divided into light b which travels toward the output screen and light c which travels toward the input window 11*a*. When light s reaches the rough surface 12*f* of the rough, surface-hardened layer of the input window 11*a*, an irregular reflection light d results and reduces brightness. However, due to the presence of the aluminum thin film 12*a*, namely, the reflective substance layer formed on the rough, surface-hardened layer 11*d*, the light c is reflected by the aluminum thin film 12*a* and then travels toward the output screen 15 instead of entering the rough, surface-hardened layer 11*d*. Accordingly, a decrease of brightness is prevented.

Hereinbelow, the data of the image contrast characteristics obtained by the X-ray image intensifier of this embodiment and the X-ray image intensifier of the conventional structure are compared to each other by way of example the effective input screen diameter of 4 inches with reference to FIG. 3.

Figure 3:
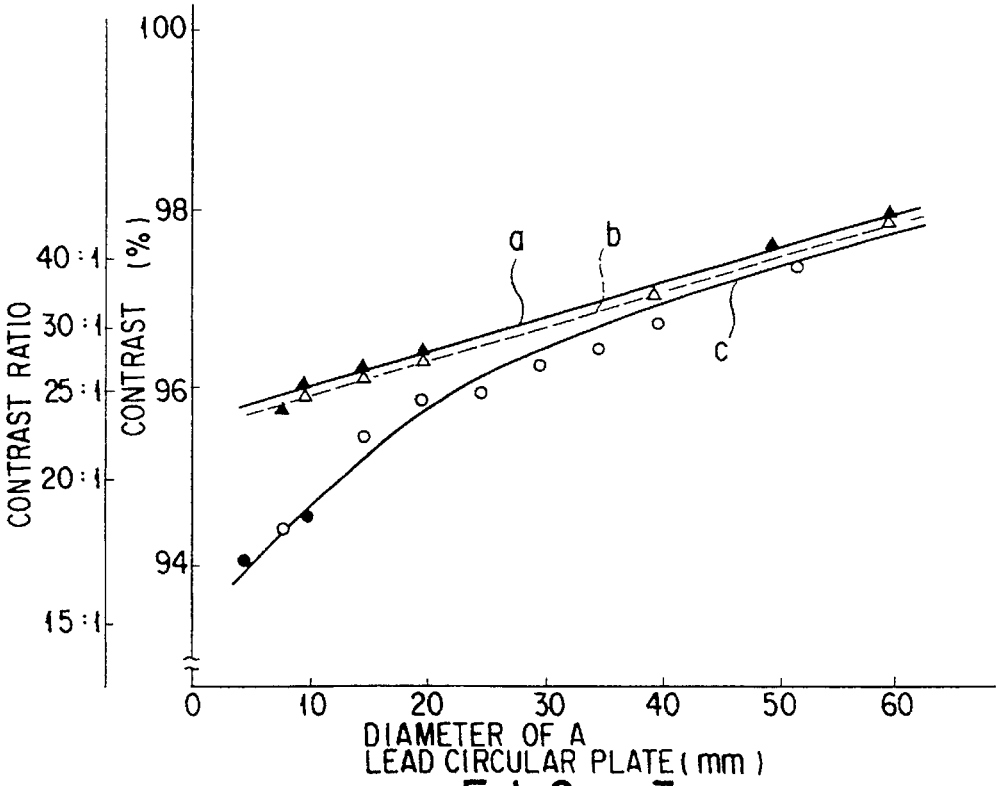
FIG. 3 is a graph showing image contrast characteristics obtained under the application of a high-energy X-ray according to an embodiment of the X-ray image intensifier of the present invention and a conventional X-ray image intensifier.

In FIG. 3, as described above, a contrast (%) and a contrast ratio were plotted on the vertical axis and a diameter of a lead circular plate was plotted on the horizontal axis. The experiment of FIG. 3 was conducted using the X-ray image intensifier having an effective input screen diameter of 4 inches and a tube voltage of 50 KV and a tube current of 1 mA.

In the case where the input window of this embodiment was used, lines a and b of FIG. 3 were obtained. More specifically, the line a was obtained for an aluminum input window. The line b was obtained for a beryllium input window, whose size is the same as that made of aluminum. The line c exhibits the image contrast which was obtained by a conventional X-ray image intensifier shown in FIG. 1.

According to the results shown in FIG. 3, the image contrast obtained by the conventional X-ray image intensifier drastically decreases as the diameter (mm) of the lead circular plate becomes smaller than 40 mm. In contrast, the contrast obtained by the X-ray image intensifier of this example linearly increases in proportional to the diameter (mm) of the lead circular plate, as shown lines a and b. Consequently, it is very easy to detect a smaller object, in particular, in the case where a light and shade are discriminated by coloring.

As described by the foregoing, the present invention made it possible to realize the X-ray image intensifier having an input window serving as an input screen, which has been considered difficult to attain.

EXAMPLE 2

Figure 4:
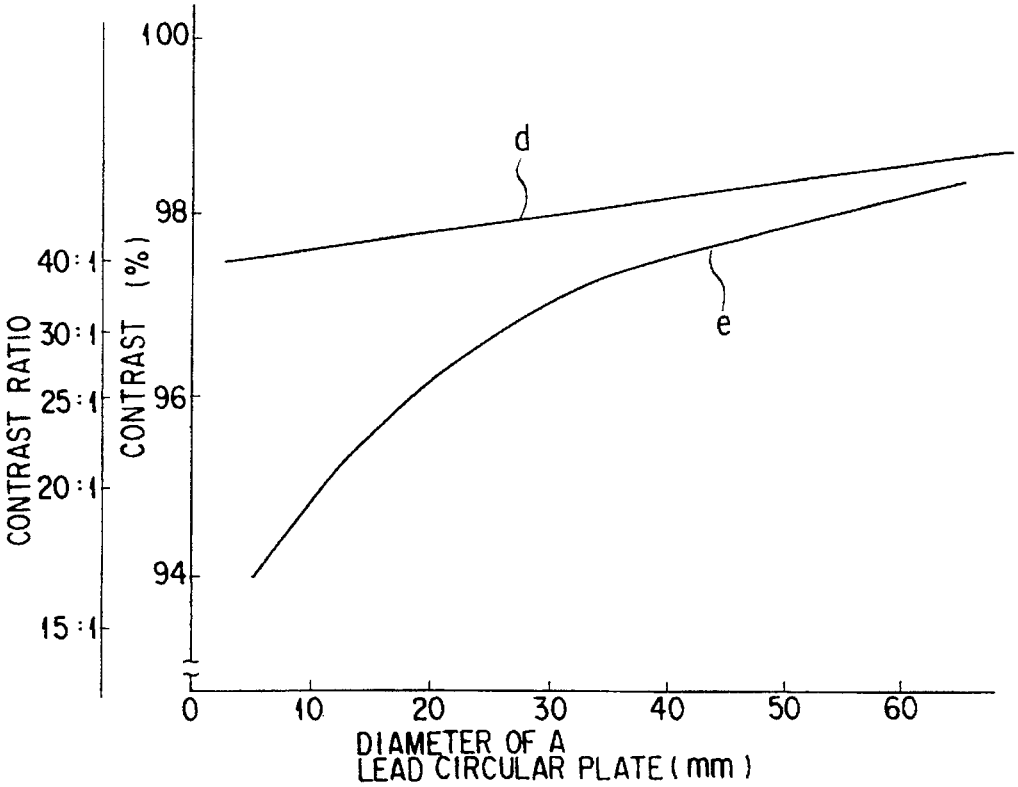
FIG. 4 is a graph showing contrast characteristics obtained under the application of a low-energy X-ray according to an embodiment of the X-ray image intensifier according to the present invention and a conventional X-ray image intensifier.

In this example, the image contrast characteristics were determined by applying a low-energy X-ray to the X-ray image intensifier (the input window is an Al-Mg alloy) which is identical to the X-ray image intensifier used in EXAMPLE 1. In FIG. 4, as described above, a contrast (%) and a contrast ratio were plotted on the vertical axis, and the diameter of the lead circular plate on the horizontal axis. An experiment was carried out at an X-ray tube voltage of 30 KV and a tube current of 1 mA.

In FIG. 4, line d shows the change in the contrast obtained by the X-ray image intensifier of this Example. Line e shows the data described above for the conventional X-ray image intensifier shown in FIG. 1.

As shown in FIG. 4, compared to the case where a high-energy X-ray (an X-ray tube voltage of 50 KV, a tube current of 1 mA) was applied, the image contrast obtained by the conventional X-ray image intensifier significantly decreases as the lead circular plate becomes less than 40 mm. On the other hand, the contrast of the X-ray image intensifier of this example increases linearly in proportional to the diameter of the lead circular plate, as shown by line d. Hence, in the X-ray image intensifier of the present invention, a smaller object can be examined with a high level of accuracy.

As explained in the foregoing, the present invention accomplished an X-ray image intensifier having a structure, which has been difficult to attain, including an input screen formed directly on the inner surface of an input window. The resulting X-ray image intensifier can provide higher image contrast.

For reference, even in the case where an Al-Mg-Si series alloy (ASTM 6000 series) is employed instead of the Al-Mg alloy used in the above Examples, similar effects can be expected.

I claim:

1. An X-ray image intensifier comprising:

a vacuum envelope comprising:

an X-ray input window, said input window being formed of metal or alloy and having an outer surface and an inner surface, and a rough surface-hardened layer formed on said inner surface; and an input screen having an entrance surface formed in direct contact with said rough surface-hardened layer and having a phosphor layer.

2. An X-ray image intensifier according to claim 1, wherein said metal X-ray input window is made of aluminum or an aluminum alloy.

3. An X-ray image intensifier according to claim 2, wherein said rough, surface-hardened layer has a Vickers hardness of 120 to 250.

4. An X-ray image intensifier according to claim 1, wherein said rough, surface-hardened layer has a surface roughness of 2 to 10 μm.

5. An X-ray image intensifier according to claim 1, wherein said rough, surface-hardened layer is formed by impinging hard spherical particles onto said inner surface of said input window.

6. An X-ray image intensifier according to claim 1, wherein said input screen further comprises a reflective substance layer formed on said rough, surface-hardened layer.

7. An X-ray image intensifier according to claim 6, wherein said reflective substance layer is a metal thin film.

8. An X-ray image intensifier according to claim 1, said rough surface-hardened layer having a Vickers hardness higher than that in an inner region of said X-ray input window.

9. An X-ray image intensifier comprising:

a vacuum envelope comprising:

an X-ray input window, said input window being formed of a metal or an alloy and having an outer surface and an inner surface; and a rough surface-hardened layer formed on said inner surface;

an input screen having an entrance surface formed in direct contact with said rough surface-hardened layer, said input screen having a phosphor layer and a photocathode formed on said phosphor layer;

a focusing electrode;

an anode; and an output screen, wherein said input screen, said focusing electrode, said anode, and said output screen are successively arranged in said vacuum envelope.

10. An X-ray image intensifier according to claim 9, wherein said metal X-ray input window is made of aluminum or an aluminum alloy.

11. An X-ray image intensifier according to claim 10, wherein said rough, surface-hardened layer has a Vickers hardness of 120 to 250.

12. An X-ray image intensifier according to claim 9, wherein said rough, surface-hardened layer has a surface roughness of 2 to 10 μm.

13. An X-ray image intensifier according to claim 9, wherein said input screen further comprises a reflective substance layer formed on said rough, surface-hardened layer.

14. An X-ray image intensifier according to claim 13, wherein said reflective substance layer is a metal thin film.

15. An X-ray image intensifier according to claim 9, said rough surface-hardened layer having a Vickers hardness higher than that in an inner region of said X-ray input window.

16. An X-ray image intensifier comprising:

a vacuum envelope comprising:

an X-ray input window, said input window being formed of aluminum or an aluminum alloy and having an outer surface and an inner surface; and a rough surface-hardened layer formed on said inner surface;

an input screen having an entrance surface formed in direct contact with said rough surface-hardened layer, said input screen having a phosphor layer and a photocathode formed on said phosphor layer;

a focusing electrode;

an anode; and an output screen, wherein said input screen, said focusing electrode, said anode, and said output screen are successively arranged in said vacuum envelope, and wherein said rough, surface-hardened layer is formed by impinging hard spherical particles onto said inner surface of said input window.

17. An X-ray image intensifier according to claim 16, wherein said rough, surface-hardened layer has a surface roughness of 2 to 10 μm.

18. An X-ray image intensifier according to claim 16, wherein said rough, surface-hardened layer has a Vickers hardness of 120 to 250.

19. An X-ray image intensifier according to claim 18, wherein said input screen further comprises a reflective substance layer formed on said rough, surface-hardened layer.

20. An X-ray image intensifier according to claim 19, wherein said reflective substance layer is a metal thin film.

21. An X-ray image intensifier according to claim 16, said rough surface-hardened layer having a Vickers hardness higher than that in an inner region of said X-ray input window.

* * * * *